US005142339A

United States Patent [19]

Kasahara et al.

[11] Patent Number: 5,142,339

[45] Date of Patent: Aug. 25, 1992

[54] IMAGE RECORDER WITH VARIABLE FUSER NIP ENTRY POSITION

[75] Inventors: Nobuo Kasahara, Yokohama; Yasunori Kawaishi, Narashino; Tatsuo Hirono, Kawasaki, all of Japan

[73] Assignee: Ricoh Company, Ltd., Tokyo, Japan

[21] Appl. No.: 786,550

[22] Filed: Nov. 1, 1991

[30] Foreign Application Priority Data

| | | | |
|---|---|---|---|
| Nov. 2, 1990 | [JP] | Japan | 2-298182 |
| Nov. 9, 1990 | [JP] | Japan | 2-305278 |
| Apr. 26, 1991 | [JP] | Japan | 3-97108 |
| Jun. 27, 1991 | [JP] | Japan | 3-156732 |

[51] Int. Cl.[5] ..... G03G 15/00

[52] U.S. Cl. ..... 355/282; 355/275; 355/290; 355/309

[58] Field of Search ..... 355/274, 275, 282, 290, 355/309, 313, 271

[56] References Cited

U.S. PATENT DOCUMENTS

| | | | |
|---|---|---|---|
| 3,697,170 | 10/1972 | Bhagat et al. | 355/274 X |
| 4,928,148 | 5/1990 | Higashi | 355/290 |
| 5,017,970 | 5/1991 | Sakata | 355/290 |
| 5,027,159 | 6/1991 | Oda et al. | 355/271 |

FOREIGN PATENT DOCUMENTS

| | | | |
|---|---|---|---|
| 2-20882 | 1/1990 | Japan | 355/275 |
| 2-306262 | 12/1990 | Japan | 355/274 |

*Primary Examiner*—Joan H. Pendegrass

*Attorney, Agent, or Firm*—Oblon, Spivak, McClelland, Maier & Neustadt

[57] ABSTRACT

An image recorder capable of preventing a non-fixed toner image carried on a paper sheet from being rubbed with no regard to the elasticity or the thickness of the paper sheet. A belt transports the paper sheet with a non-fixed toner image. An upper guide plate and a lower guide plate face each other for guiding the paper sheet to a fixing device. The relative position of the upper and lower guide plates and the belt is variable to prevent the non-fixed toner image from contacting the upper or lower guide plate.

11 Claims, 7 Drawing Sheets

10
12
11
13
14
15
4
17
18
1
19
S
16
9

IMAGE RECORDER WITH VARIABLE FUSER NIP ENTRY POSITION

BACKGROUND OF THE INVENTION

The present invention relates to a laser printer, digital copier or similar image recorder capable of forming an image on either of opposite sides of a paper sheet, as desired.

Conventional image recorders include one which forms a toner image on at least one side of a paper sheet and fixes the toner image by a fixing device, i.e., a pair of heat rollers while transporting the sheet by a belt and via a guide. This type of image recorder is disclosed in, for example, Japanese Patent Laid-Open Publication No. 63559/1982 and and Japanese Utility Model Laid-Open Publication No. 166650/1983 and will be referred to as a first type of image recorder hereinafter.

Another or second type of conventional image recorder has a rotatable photoconductive element, optical writing means for writing a latent image on the photoconductive element, and developing means for developing the latent image to produce a primary toner image. An intermediate image transfer body is implemented as a belt which faces the photoconductive element and allows a paper sheet to pass through between it and the photoconductive element. Intermediate image transferring means transfers the primary toner image to a paper sheet or the belt as a secondary toner image. Secondary toner image transferring means is located downstream of the intermediate image transferring means for transferring the secondary toner image to a paper sheet. A fixing device has heat rollers for fixing the toner image by passing a paper sheet driven out from the belt therethrough. The second type of image recorder is capable of recording an image on one or both sides of a paper sheet. In a front record mode, the primary toner image is transferred from the photoconductive element to the front or upper surface of of a paper sheet on the belt by the intermediate image transferring mans. In a rear record mode, the primary toner image is once transferred to the belt as a secondary toner image by the intermediate image transferring means, and then the secondary toner image is transferred to the rear or lower surface of the paper sheet on the belt by the secondary toner image transferring means. Further, in a two-side record mode, the secondary toner image is transferred to the belt in the same manner as in the rear record mode, then a primary toner image is formed on the photoconductive element in the same manner as in the front record mode, and then the primary and second toner images are respectively transferred to the front and the rear of a paper sheet being transported by the belt.

Both the first and second types of image recorders are operable not only with a toner of one color but also with a plurality of toners of different colors. By using toners of different colors, each of the two types of image recorders implements multicolor or fullcolor recording in which superposed toner images of different colors are formed on the photoconductive element or the belt. Hence, three different record modes are available with such an image recorder, i.e., a front record mode for forming a monocolor toner image or a multicolor or fullcolor toner image on the front of a paper sheet, a rear record mode for forming the toner image on the rear of a paper sheet, and a two-side record mode which is the combination of the front and rear record modes. By selecting any one of such record modes, it is possible to form an image on one or both sides of a paper sheet. This kind of system does not have to turn over a paper sheet and is, therefore, practicable with a simple and contact arrangement.

For the transfer of a toner image, an electrostatic field is generated by corona transfer, belt transfer, or roller transfer. Among them, the roller transfer or so-called bias roll transfer uses a conductive rubber roller or a bias roller made up of a conductive rubber roller and a dielectric film covering the rubber roller. The bias roller is applied with a voltage and pressed against the side of a paper sheet opposite to the image carrying side to generate a field. This kind of image transfer has an excellent image transfer efficiency, as taught in, for example, Japanese Patent Laid-Open Publication Nos. 209471/1989, 28879/1989, and 28880/1989.

In each of the first and second types of image recorders, a paper sheet carrying a toner image on one side thereof is passed through a pair of rotatable fixing rollers which face each other. When such fixing rollers fail to nip the leading edge of the paper sheet evenly in the widthwise direction of the latter, the leading edge of the paper sheet is apt to fold or crease or, in the worst case, jam the transport path. To eliminate such an occurrence, an upper guide and a lower guide are usually located just in front of the fixing rollers so as to guide the paper sheet smoothly to the rollers. However, the problem is that the leading edge of a paper sheet, except for paper sheets which are thick and have flat and elastic leading edges, is likely to become unstable, depending on the transport condition. It is likely, therefore, that the guides rub against a non-fixed toner image carried on a paper sheet, critically degrading the toner image. When the secondary toner image transferring means included in the second type of image recorder is implemented as a bias roller, it is necessary that in the front record mode the bias roller be held in contact with the belt. Should the primary toner image be transferred to a paper sheet or to the belt (rear record mode) while the bias roller is in contact with the belt, the bias roller would rub against the primary tonr image.

SUMMARY OF THE INVENTION

It is, therefore, an object of the present invention to provide an image recorder capable of preventing a non-fixed toner image on a paper sheet from being disturbed with no regard to the thickness or the elasticity of the paper sheet.

It is another object of the present invention to provide a generally improved image recorder.

In accordance with the present invention, an image recorder capable of recording an image on at least either of opposite sides of a paper sheet comprises a fixing device for fixing a toner image formed on either of opposite sides of a paper sheet, a transporting device for transporting the paper sheet to the fixing device, a guide provided integrally with the fixing device for guiding the paper sheet being transported by the transporting device to the fixing device, a direction changing device for changing the direction for transporting the paper sheet such that the toner image carried on the paper sheet does not contact the guide.

Also, in accordance with the present invention, an image recorder capable of selectively recording an image on at least either of opposite sides of a paper sheet comprises a rotatable photoconductive element, an optical writing device for writing a latent image on the photoconductive element in an inverted position or a non-inverted position, a developing device for developing the latent image to produce a primary toner image, a belt facing the photoconductive element for causing a paper sheet to pass through between the belt and the photoconductive element, an intermediate image transferring member for transferring the primary toner image to the paper sheet or transferring the primary toner image to the belt as a secondary toner image, a secondary toner image transferring member located downstream of the intermediate image transferring member and comprising a bias roller fixed in place for transferring the secondary toner image to the paper sheet, a fixing device comprising a pair of rollers for fixing by heat any of the toner images transferred to the paper sheet being driven out from the belt, and a displacing device for displacing the belt into and out of contact with the bias roller.

BRIEF DESCRIPTION OF THE DRAWINGS

The above and other objects, features and advantages of the present invention will become more apparent from the following detailed description taken with the accompanying drawings.

DESCRIPTION OF THE PREFERRED EMBODIMENTS

Figure 1:
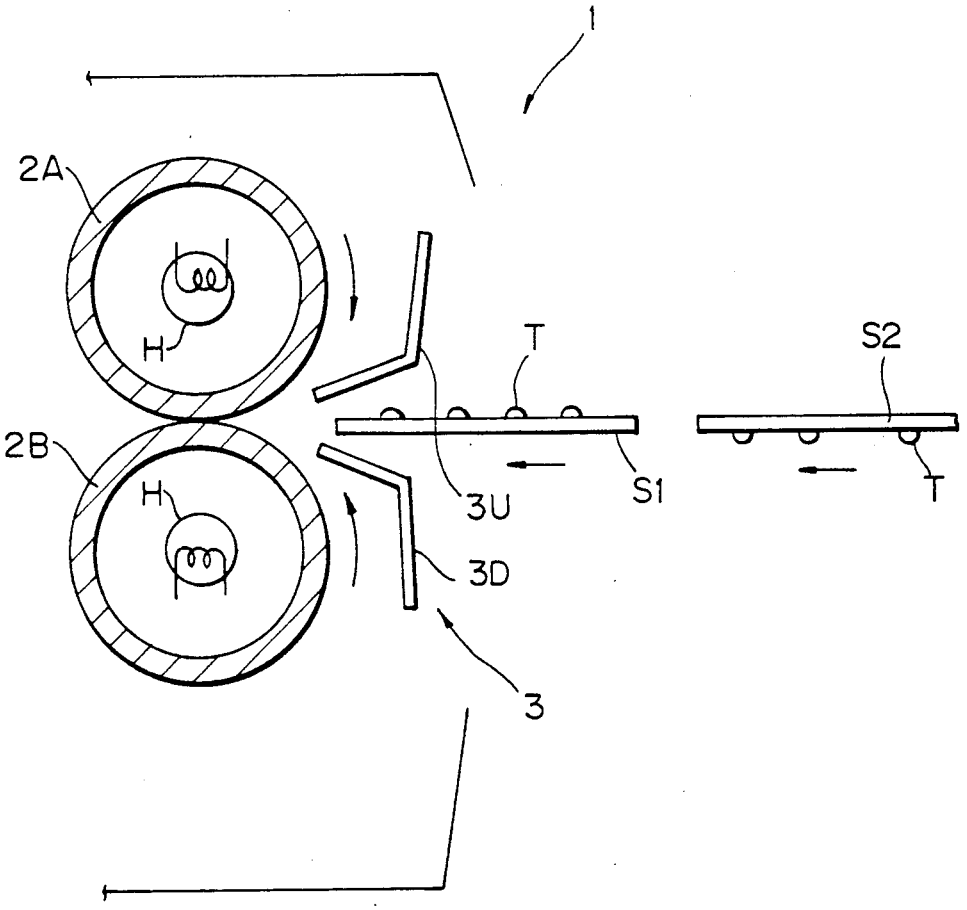
Fig. 1 PRIOR ART
FIG. 1 is a section showing a fixing device included in a conventional image recorder.

To better understand the present invention, a brief reference will be made to a conventional image recorder capable of forming an image on either of opposite sides of a paper sheet, particularly a fixing device thereof, shown in FIG. 1. As shown, the fixing device has a pair of rollers 2A and 2B each accommodating a heat source H therein and rotatable in a direction indicated by an arrow in the figure. A paper sheet S1 carrying a toner image T on the front or upper surface or a paper sheet S2 carrying it on the rear or lower surface is passed through between the rollers 2A and 2B to have the image T fixed. At this instant, if the rollers 2A and 2B fail to nip the leading edge of the paper sheet S1 or S2 evenly in the widthwise direction of the sheet, the former would cause the latter to fold, crease or jam the transport path. To eliminate such an occurrence, a guide 3 is positioned just in front of the rollers 2A and 2B with respect to the direction of paper feed in such a manner as to guide the paper sheet S1 or S2 smoothly to between the rollers 2A and 2B. The guide 3 is made up of an upper guide 3U and a lower guide 3D. The problem with this type of image recorder is that the upper guide 3U or the lower guide 3D is apt to contact the toner imate T of the paper sheet S1 or S2 since the leading edge of the sheet S1 or S2 being transported is often unstable in position. Then, the guide 3U or 3D would rub against the toner image T to make it unusable as a recording.

Preferred embodiments of the image recorder in accordance with the present invention will be described hereinafer. In the figures, the same or similar parts and structural elements are designated by like reference numerals, and redundant description will be avoided for simplicity.

First Embodiment

Figure 2:
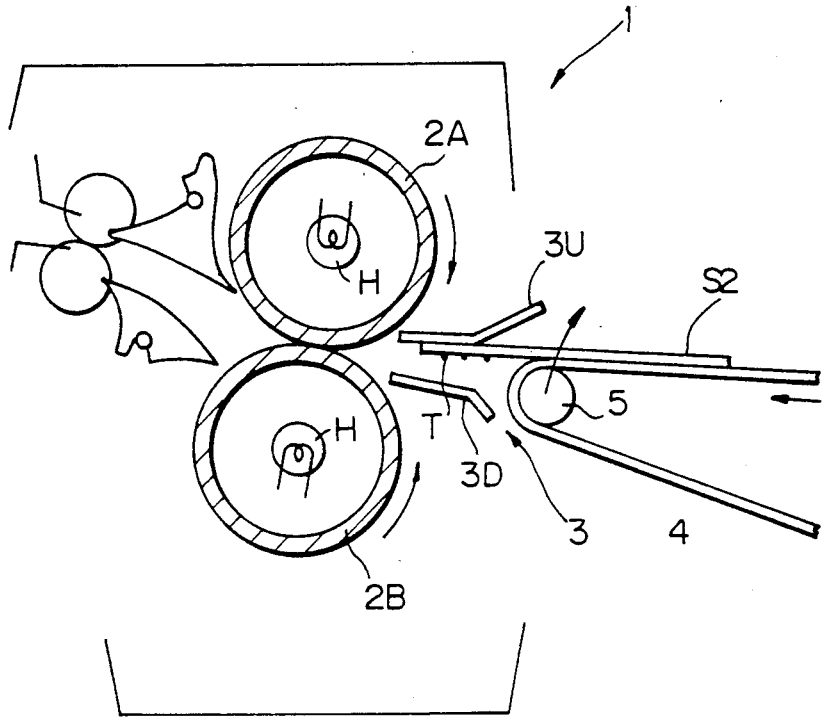
FIGS. 2 and 3 are sections showing a fixing device included in a first embodiment of the image recorder in accordance with the present invention together with associated members.
Figure 3:
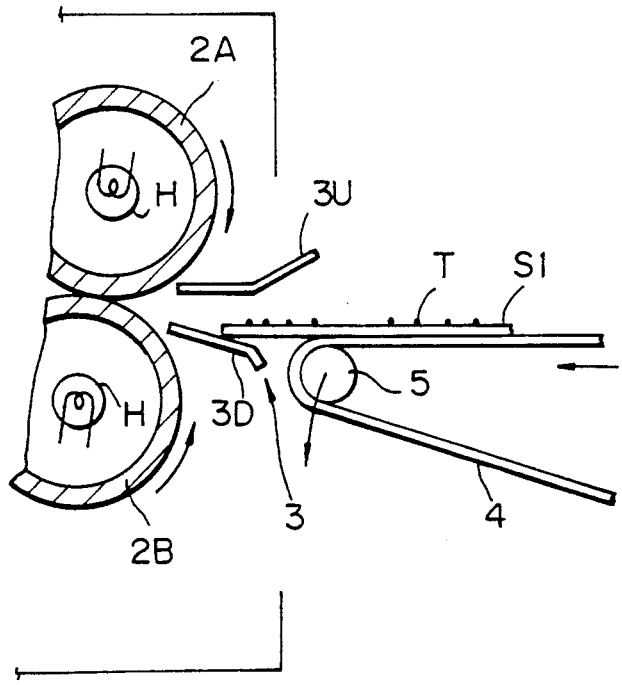

Referring to FIGS. 2 and 3, an image recorder embodying the present invention has a belt 4 which transports a paper sheet S2 carrying a toner image T on the rear thereof toward a fixing device 1. The belt 4 is passed over a pair of rollers which are journalled to common support members, not shown. The support members, roller pair and belt 4 are constructed into a belt unit. A support roller 5 is one of the roller pair and located closer to the fixing device 1 than the other support roller. Displacing means, not shown, moves the support roller 5 up and down about the other roller which is located upstream of the roller 5 with respect to the direction of paper transport. Specifically, a solenoid, not shown, is affixed to a stationary member and has the plunger thereof connected to the support roller 5. The solenoid may be replaced with a cam arrangement or a link mechanism, if desired. Such displacing means is controlled by an imaging mode signal which a control section included in the image recorder generates. When the imaging mode signal is indicative of a rear (upper surface) record mode, the displacing means or solenoid is energized to raise the support roller 5, i.e., the belt 4 to a position shown in FIG. 2. Then, the leading edge of the paper sheet S2 contacts an upper guide 3U at the front (upper surface) thereof. As a result, the paper sheet S2 has the side thereof carrying the toner image T spaced apart from the lower guide 3D and, at the same time, has the other side or rear thereof guided by the upper guide 3U. This prevents the lower guide 3D from rubbing against the toner image T and prevents the paper sheet S2 from folding or creasing. On the other hand, when the imaging mode signal is indicative or a front record mode, the solenoid is deenergized with the result that the support roller 5 is lowered by a spring, not shown, to a position shown in FIG. 3. In this condition, the rear of the leading edge of a paper sheet S1 contacts the lower guide 3D. Hence, the toner image T carried on the upper surface of the paper sheet S1 is spaced apart from the upper guide 3U while the lower surface of the same is guided by the lower guide 3D. This is successful in preventing the upper guide 3D from rubbing against the toner image and preventing the paper sheet S1 from folding or creasing.

Second Embodiment

Figure 4:
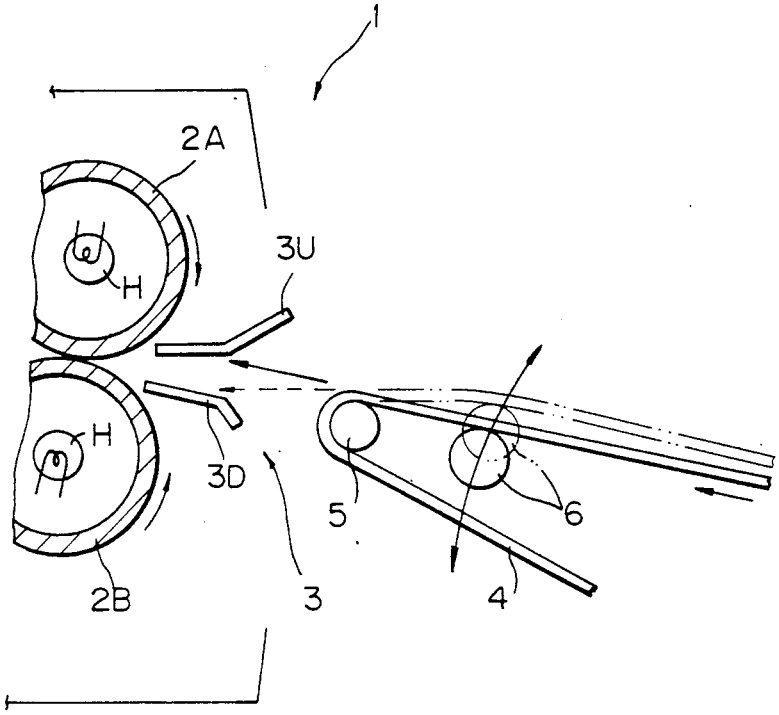
FIGS. 4–6 are sections showing respectively a second to a fourth embodiment of the present invention.

FIG. 4 shows an alternative embodiment of the present invention. In this embodiment, the displacing means for moving the belt 4 is implemented as a roller 6 which is located in the vicinity of the support roller 5. The roller 6 is movable up and down in response to the imaging mode signal, as indicated by an arrow in the figure. When the roller 6 is raised, it urges the belt 4 upward such that the inclination of part of the belt 4 extending between the support roller 5 and the roller 6 changes. As a result, a paper sheet enters the guide 3 in a position indicated by a phantom line and corresponding to the position shown in FIG. 3. When the roller 6 is lowered, a paper sheet enters the guide 3 in a position indicated by a solid line and corresponding to the position shown in FIG. 2.

Third Embodiment

Figure 5:
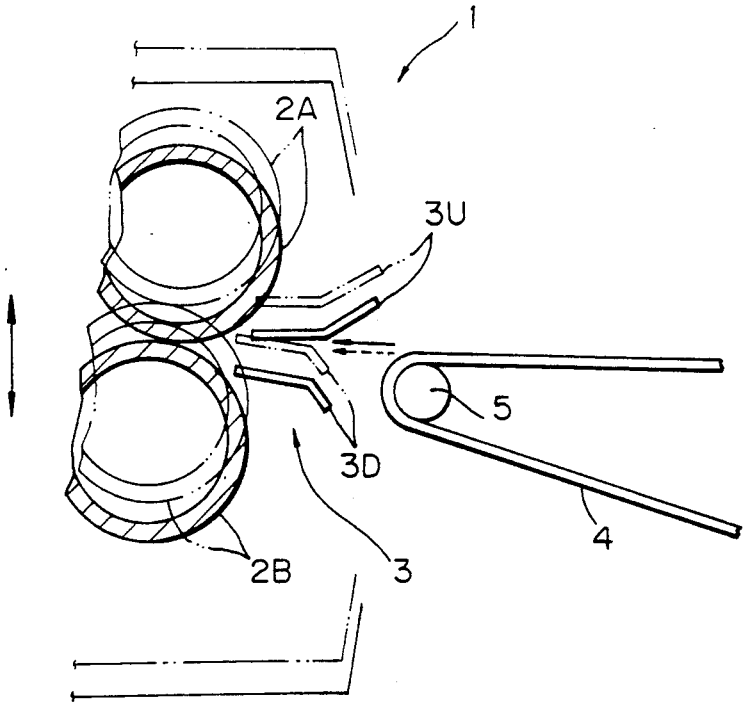

Referring to FIG. 5, another alternative embodiment of the present invention will be described. In this embodiment, the belt 4 and support roller 5 are fixed in place while the fixing device 1 is moved up or down in response to the imaging mode signal by the displacing means corresponding to those of the first and second embodiments. Eventually, the imaginary extension of the belt surface is directed toward the upper guide 3U or the lower guide 3D, as indicated by a solid line or a phantom line in the figure. Then, a paper sheet is transported in the same position as in the first embodiment.

Fourth Embodiment

Figure 6:
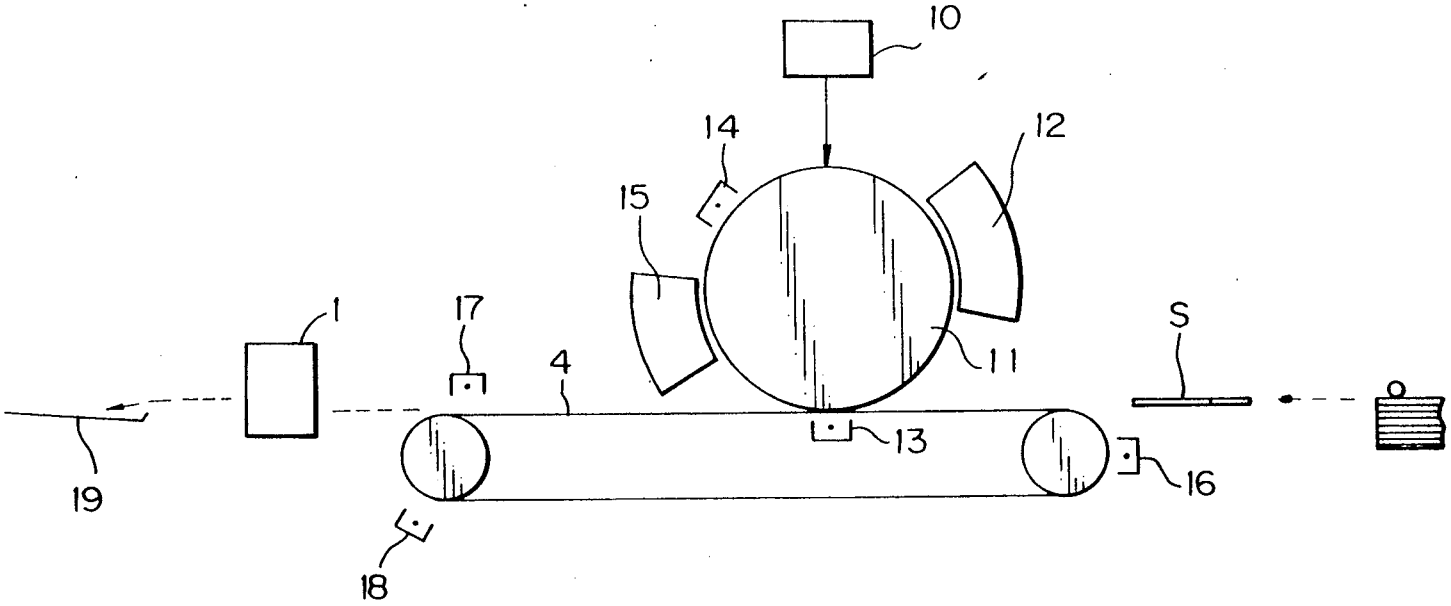

Another alternative embodiment of the present invention will be described with reference to FIG. 6. As shown, optical writing means 10 writes a latent image on a rotatable photoconductive element or drum 11 in an inverted or non-inverted position. Developing means 12 develops the latent image by a toner to produce a primary toner image. A belt 4 is located to face the drum 11 and allows a paper sheet S to pass between it and the drum, playing the role of an intermediate image transfer body. Primary toner image transferring means 13 transfers the primary toner image to the paper sheet S. Intermediate image transferring means transfers the primary toner image to the belt 4 as a secondary toner image and is constituted by the primary toner image transferring means 13. There are also shown in FIG. 6 a main charger 14, a cleaning device 15, a polarity inverting unit 16, chargers 17 and 18, and a tray 19 for stacking recordings thereon.

Assume a front record mode in which a toner image is formed on the front or upper surface of the paper sheet S. In FIG. 6, the charger 17 is supplied with AC and DC (negative) for separating the paper sheet S from the belt 4, although it does not function in the front record mode. The chargers 18 and 16 are applied with superposed AC and DC (positive) in order to, respectively, discharge the surface of the belt 4 for preparing it for polarity inversion and to invert the polarity of the discharged surface of the belt 4. Neither the charger 18 nor the charger 16 functions in the front record mode. As the drum 11 is rotated, the main charger 14 uniformly charges the surface of the drum 11 to negative polarity in the dark. The charged surface of the drum 11 is exposed to imagewise light issuing from the writing section 10, so that the charge in the image area of the drum 11 is dissipated. In the illustrative embodiment, the imagewise light forms a latent image on the drum 11 in an inverted position, i.e., mirror image position, so that a non-inverted image may be formed on the paper sheet S. The developing means 12 develops the latent image by a negatively charged toner to thereby produce a primary toner images. The leading edge of the primary toner images meets the leading edge of the paper sheet S having been fed at a predetermined timing by a register roller at the position where the primary toner image transferring means 13 is located. Then, the transferring means 13 transfers the primary toner image from the drum 11 to the upper surface of the paper sheet S by positive corona discharge which is opposite in polarity to the toner. The paper sheet S carrying the primary toner image thereon is transported toward the fixing device 1 by the belt 4. After the toner image has been fixed on the paper sheet S by the fixing device 1, the paper sheet S is driven out onto the tray 19. Thereafter, the cleaning device 15 removes the toner remaining on the drum 11 to prepare the drum 11 for another recording cycle.

Assume a rear record mode for forming a toner image on the rear or lower surface of the paper sheet S. In this mode operation, AC and DC (negative) are applied to the polarity inverting unit 16. This unit 16 and the chargers 18 and 16 are rendered operative. The procedure from the uniform charging of the drum 11 to the formation of a primary toner image is the same as in the front record mode, except that the latent image is formed on the drum 11 in a non-inverted position. The primary toner image is transferred to the belt 4 as an inverted secondary toner image, i.e., mirror image by the primary toner image transferring means 13 which effects positive corona discharge. In the embodiment, therefore, the primary toner image transferring means 13 plays the role of intermediate image transferring means which transfers the primary toner image to the belt 4 as a secondary toner image. The charger 18 discharges the belt 4 together with the secondary toner image in order to invert the polarity of the belt 4. Subsequently, the polarity inverting unit 16 inverts the polarity of the belt 4 to positive polarity by corona discharge. The primary toner image transferring means 13 transfers by corona discharge the positively charged secondary toner image from the belt 4 to the lower surface of the paper sheet S which is fed at a predetermined timing toward the transferring means 13. In this sense, the primary toner image transferring means 13 also functions as secondary toner image transferring means which transfers a secondary toner image to the paper sheet S. The paper sheet S carrying the secondary toner image is separated from the belt 4 by the charger 17 and then driven out onto the tray 19 face down via the fixing device 1.

It is to be noted that the charger 17 of the illustrative embodiment has a function of discharging the belt 4 in addition to the above-stated function.

Fifth Embodiment

Figure 7:
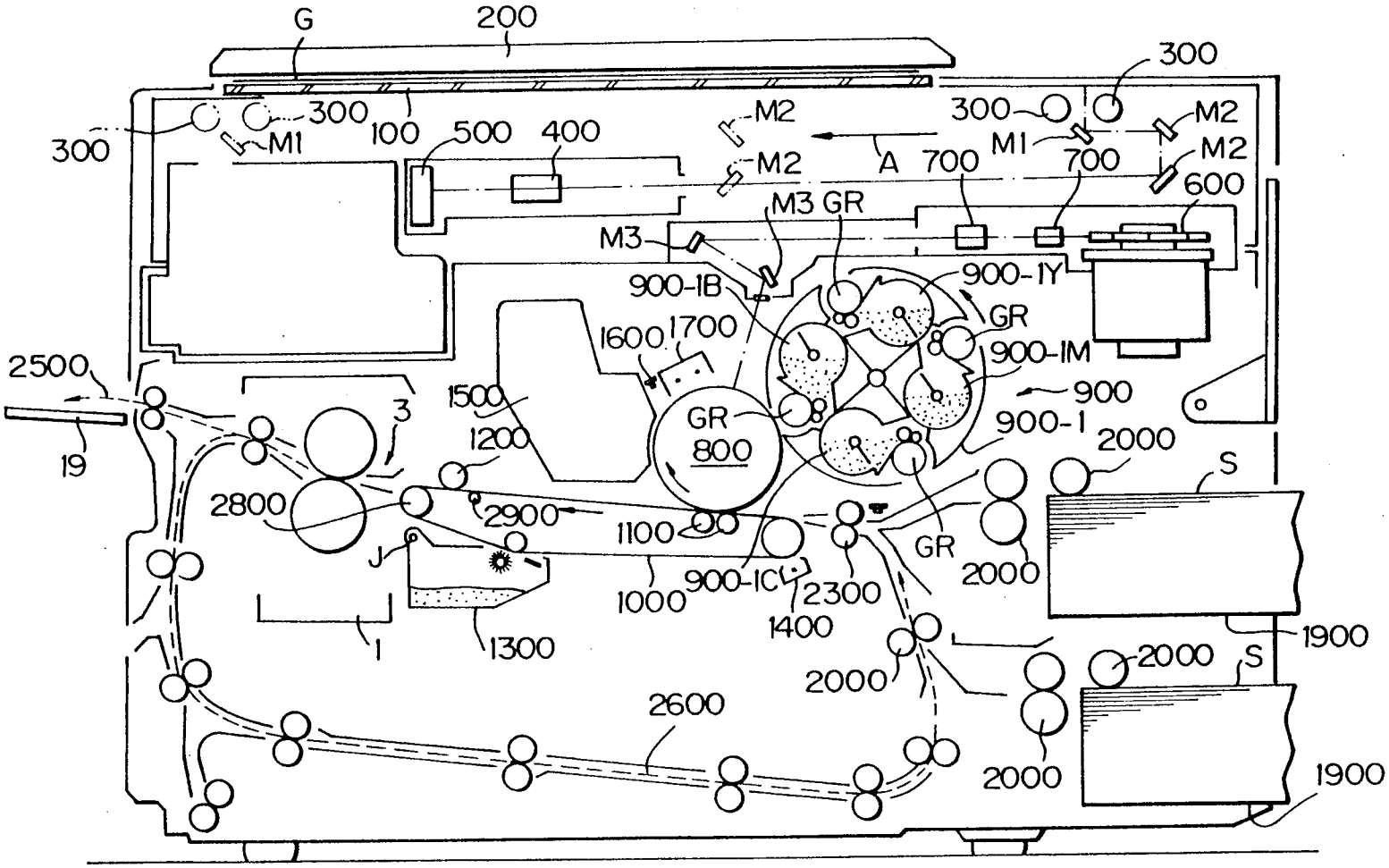
FIG. 7 is a section showing a fifth and a sixth embodiment of the present invention which are implemented as color image recorders.
Figure 8:
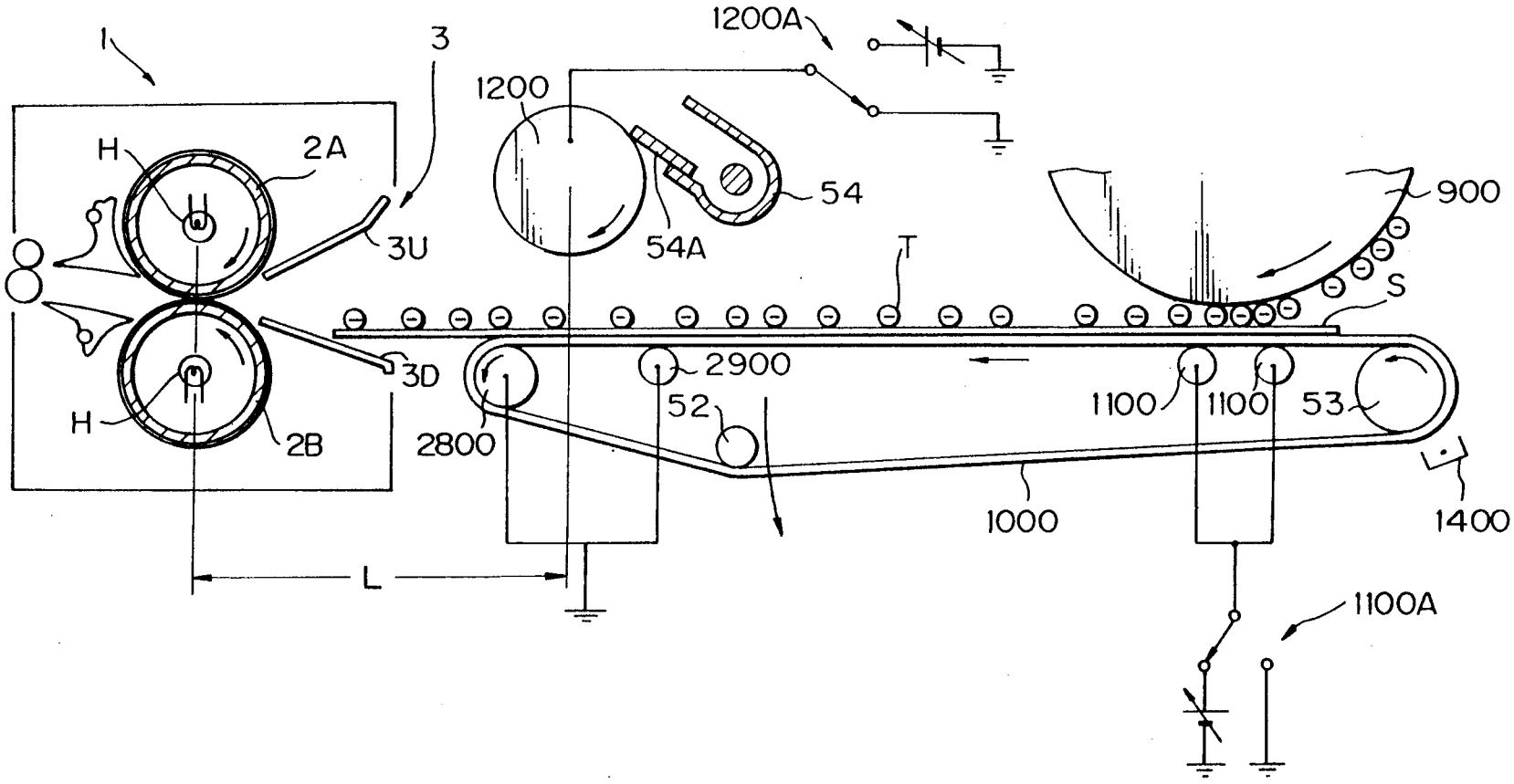
FIGS. 8 and 9 shows bias roller transferring means included in the embodiments of FIG. 7.
Figure 9:
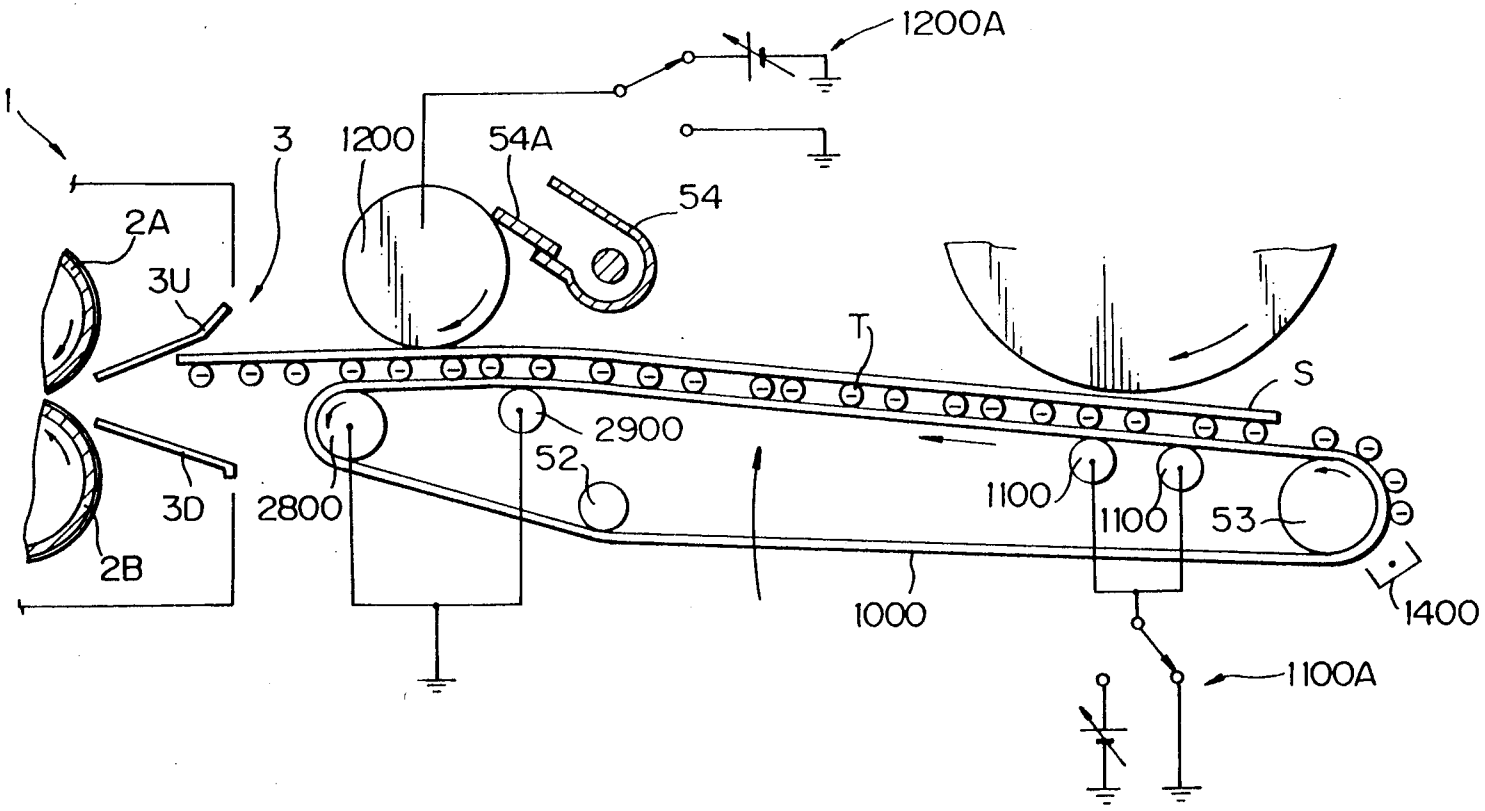

Referring to FIGS. 7–9, another alternative embodiment of the present invention is shown and implemented as a color image recorder. As shown in FIG. 7, the color image recorder is generally made up of document reading means, optical writing means, image forming and fixing means, paper feeding means, and paper transporting means. The document reading means has a glass platen 100 to be loaded with a document G, a platen cover 200 for covering the glass platen 100 and document G laid thereon, a lamp 300 for illuminating the document G, a first mirror M1 movable integrally with the lamp 300 in a scanning direction A, a second mirror M2 movable in the scanning direction A in interlocked relation to the first mirror M1, a reduction lens 400, a color CCD (Charged Coupled Device) image sensor 500, and a scanner controller, not shown. In operation, as the document G is scanned, the resulting image information is converted to an electric signal representative of blue, green, red and black components by the color CCD image sensor 500 and then written to storing means. Further, the electric signal is manipulated by an image processing section, not shown, and then sent to the writing means.

The writing means has a semiconductor laser, means for superposing the above-mentioned electric signal on a current for driving the laser, a rotatable polygonal mirror 600 for steering a beam issuing from the laser, focusing optics 700 including an f-theta lens, and a third mirror M for reflecting the laser beam to a photoconductive element which is implemented as a drum 800. Since the writing means stores the image information in the form of a digital signal, the writing order, for example, may be changed to write an inverted image or a non-inverted image on the drum 800, as desired.

The image forming means has, in addition to the drum 800, developing means 900 for developing the latent image written to the drum 800 by the optical writing means to thereby produce a primary toner image. A belt 1000 is located to face the drum 800 and allows a paper sheet to pass through between the belt 1000 and the drum 800. Bias rollers 110 serve as intermediate image transferring means and are fixed in a position where they face the drum 800 with the intermediary of the belt 1000. A bias roller 1200 constitutes secondary toner image transferring means and is positioned above the belt 1000 and downstream of a position where the belt 1000 directly faces the drum 800, i.e., where the bias rollers 1100 are located with respect to the direction in which the belt 1000 moves. Belt cleaning means 1300 is located downstream of the bias roller 1200 with respect to the above-mentioned direction. A charger 1400 faces the belt 1000 at a position downstream of the belt cleaning means 1300 and plays the role of polarity inverting means in the event of two-side copying. A cleaner 1500, a discharge lamp 1600 and a main charger 1700 are sequentially arranged around the drum 800 in this order.

As shown in FIGS. 8 and 9, biasing means 1100 is associated with the bias roller 1100 and selectively switched over to a state for applying a positive voltage or a grounded state in matching relation to a record mode.

The developing means 900 has a rotatable hollow cylinder 900-1 which is partitioned to form four developing sections 900-1Y, 900-1M, 900-1C and 900-1B which store a yellow toner, magenta toner, cyan toner, and black toner, respectively. The cylinder, or revolver, 900-1 is rotated to a position where one of the developing sections storing a color toner matching the color of a latent image, i.e., a developing roller GR accommodated in such a developing section faces the latent image. The belt cleaning means 1300 is rotatable about a fulcrum J into contact with the belt 1000 in the event of cleaning. The fixing means 1 is located downstream of the belt 1000 to fix the toner image on the paper sheet S by heat. The configuration of the fixing means 1 corresponds to the configuration shown in FIG. 1. The paper feeding means has paper feeding sections 1900 each storing a stack of paper sheets S, pick-up rollers 200, a register roller 2300, etc.

The transporting means has guides and rollers arranged along a path 2500 extending from the fixing means 1 to the tray 19, guides and rollers arranged along a path 2600 for recycling the paper sheet S from the fixing means 1 to the register roller 2300, a selector for selecting either of the two paths 2500 and 2600, etc. Two different transport modes are available with the transporting means, i.e., a one pass mode and a recycle mode. In the one pass mode, the paper sheet S is transported from either of the paper feeding sections 1900 to the fixing means 1 via the drum 800 and then to the path 2500. In the recycle mode, the paper sheet S is steered from the fixing means 1 toward the register roller 2300 along the path 2600 and then transported to the tray 19 via the drum 800, fixing means 1, and path 2500.

The bias roller 1200 is made of, for example, conductive rubber. The biasing means switches over the voltage to be applied to the bias roller 1200. As shown in FIGS. 8 and 9, a cleaner 54 has a blade 54A contacting the bias roller 1200. The bias roller 1200 is fixed at a position immediately preceding, among the rollers supporting the belt 1000, a support roller 2800 located downstream of the others for separating the paper sheet S from the belt 1000. The biasing means 1200A is connected to the bias roller 1200, as stated earlier. A counter electrode in the form of a roller 2900 substantially faces the bias roller 1200 with the intermediary of the belt 1000. Specifically, the roller 2900 cooperates with the support roller 2800 as a counter electrode associated with the bias roller 1200.

The bias roller 1200 and the belt 1000 are related to each other, as follows. As shown in FIGS. 8 and 9, the belt 1000 is passed over the support rollers 2800, 52 and 63 as well as other rollers which are in turn supported by a framework, not shown. The framework is rotatable about the support roller 53. A solenoid, not shown, is connected to the free end of the framework to raise it or lower it, depending on the record mode. Specifically, in a front record mode, the solenoid is deenergized to lower the framework to a position where the free end thereof abuts against a stop, as shown in FIG. 8. In this position, the upper ends of the rollers 53, 1100, 2900 and 2800 are aligned, and the belt 1000 is sufficiently spaced apart from the bias roller 1200 with the imaginary extension thereof intersecting the lower guide 3D. The support roller 2800 is basically aligned with the other rollers 53, 1100 and 2900, as shown in FIG. 8. However, the support roller 2800 is not fixed in such a position, i.e., it yields downward when urged from the above. Specifically, the support roller 2800 is connected to the counter electrode roller 2900 by an arm, not shown, and rotatable about the roller 2900. The arm is constantly biased clockwise by a spring, not shown. As shown in FIG. 8, so long as an external force does not act on the support roller 2800, the rotation of the arm due to the spring is inhibited by a stop, not shown, maintaining the belt 1000 in the linear position. In a rear record mode, the solenoid is energized to raise the framework until the free end thereof abuts against a stop, as shown in FIG. 9. While the framework is so raised, part of the belt 1000 intervening between the rollers 2900 and 2800 is urged by the bias roller 2800 with the result that the roller 2800 connected to the roller 2900 by the arm is rotated counterclockwise about the roller 2900. Consequently, the belt 1000 is pressed against the bias roller 1200 and slightly bent at the position where the roller 2900 is located. In this condition, the imaginary extension of the part of the belt 1000 extending between the rollers 2900 and 2800 intersects the upper guide 3U.

The procedure from the image transfer to the fixation will be described in relation to typical record modes, i.e., a front record mode and a rear record mode.

As shown in FIG. 8, in a front record mode, the bias roller 1200 is spaced apart from the belt 1000, the biasing means 1200A is connected to ground, and the imaginary extension of the belt 1000 intersects the lower guide 3D. In FIG. 7, a latent image is formed on the drum 800 by the writing means and then developed by the developing means 900. As a result, a negatively charged primary toner image is formed on the drum 800, as shown in FIG. 8. The biasing means 1100A is switched over to the state for applying a positive bias to the bias roller 1100. The toner image is transferred from the drum 800 to a paper sheet S being transported by the belt 1000. The paper sheet S with the toner image is driven toward the fixing device 1. The rear of the leading edge of the paper sheet S where no images are formed is guided by the lower guide 3D. The rollers 2A and 2B of the fixing device 1 fix the toner image on the paper sheet S by heat. Hence, neither the bias roller 1200 nor the guide 3 contacts or rubs against the toner image.

In a rear record mode, as shown in FIG. 9, the belt 1000 is pressed against the bias roller 1200, the biasing means 1100A is switched over to the state for applying a positive bias voltage to the bias rollers 1100, and the imaginary extension of the left portion of the belt 1000 intersects the upper guide 3U. In FIG. 7, the primary toner image produced by the developing means 900 is transferred to the belt 1000 as a secondary toner image. Then, the biasing means 1100A is connected to ground. The secondary toner image is transferred from the belt 1000 to the lower surface of a paper sheet S being transported by the belt 1000. The paper sheet S carrying the toner image on the lower surface or rear thereof is transported toward the rollers 2A and 2B of the fixing device 1 while having the upper surface or front thereof where no images are formed guided by the upper guide 3U. Hence, the paper sheet S is transported in contact with the bias roller 1200 for image transfer and has the toner image thereof surely protected from the guide 3.

While the above description has concentrated on a toner image of single color, it is also true with a multicolor image. Generally, an image recorder of the type to which the present invention pertains is operable with various sizes of paper sheets. If the size of a given paper sheet S is smaller than the distance L, FIG. 8, between the bias roller 1200 and the nipping position between the rollers 2A and 2B, the paper sheet S cannot be adequately handed over from the belt 1000 to the fixing device 1. In light of this, the distance L is selected to be shorter than the length of a paper sheet of smallest size applicable to the image recorder. This insures the adequate transport of paper sheets even when the paper size is changed. In addition, the reduction in transport distance is successful in reducing the so-called first copying time and miniaturizing the overall construction. Of course, such a distance is applicable to an image recorder of the type moving the bias roller 1100 relative to the belt 1000 which is stationary.

In the front record mode, i.e., when the paper sheet S carrying an image on the front thereof is guided by the lower guide 3D (see FIG. 8), the heater H incorporated in the roller 2A is energized. In the rear record mode (see FIG. 9), the heater H of the roller 2B is energized.

Sixth Embodiment

This embodiment will also be described with reference to FIGS. 7–9. In this embodiment, the fixing device 1 and bias roller 1200 are movable up and down relative to the belt 1000 which is stationary. The fixing means 1 is moved in the same manner and by the same means as in the third embodiment.

In the front record mode, this embodiment positions the various components as shown in FIG. 8 by raising the fixing device 1 and bias roller 1200 relative to the belt 1000. In this condition, the image surface of the paper sheet S is spaced apart from the bias roller 1200 and upper guide 3U while the paper sheet S is guided by the lower guide 3D at the rear thereof. This prevents the bias roller 1200 and guide 3 from rubbing against the image surface of the paper sheet S. In the rear record mode, the embodiment sets up the condition shown in FIG. 9 by lowering the fixing device 1 and bias roller 1200 relative to the belt 1000. In FIG. 9, the bias roller 1200 contacts the rear of the paper sheet S where no images are present while the upper guide 3U guides the front or upper surface of the paper sheet S. As a result, not only the bias roller 1200 functions in the expected manner, but also the guide 3 is prevented from disturbing the the toner image.

In the illustrative embodiment, the imaginary extension of the left portion of the belt 1000, i.e., the extension of the upper surface of the belt 1000 adjacent to the fixing device 1 intersects either of the upper and lower guides 3U and 3D, and the fixing device 1 is movable to a position where the above-mentioned extension of the belt 1000 intersects the other guide 3U or 3D. For the rest of the construction and operation, this embodiment is identical with the fifth embodiment.

In summary, it will be seen that the present invention provides an image recorder which surely prevents a bias roller and a guide from rubbing against a non-fixed toner image formed on a paper sheet with no regard to the thickness or the elasticity of the paper sheet.

Various modifications will become possible for those skilled in the art after receiving the teachings of the present disclosure without departing from the scope thereof.

What is claimed is:

1. An image recorder capable of recording an image on at least either of opposite sides of a paper sheet, comprising:

fixing means for fixing a toner image formed on either of opposite sides of a paper sheet;

transporting means for transporting said paper sheet to said fixing means;

guiding means provided integrally with said fixing means for guiding said paper sheet being transported by said transporting means to said fixing means; and direction changing means for changing a direction for transporting said paper sheet such that said toner image carried on said paper sheet does not contact said guiding means.

2. An image recorder as claimed in claim 1, wherein said transporting means comprises a plurality of support rollers and a belt passed over said plurality of support rollers.

3. An image recorder as claimed in claim 2, wherein said direction changing means comprises support roller displacing means for selectively raising or lowering, among said plurality of support rollers, the support roller neighboring said guiding means and located at the most downstream side with respect to the intended direction of paper transport.

4. An image recorder as claimed in claim 2, wherein said direction changing means comprises belt displacing means for changing the inclination of the surface of said belt by bending said belt.

5. An image recorder as claimed in claim 2, wherein said direction changing means comprises guide displacing means for selectively raising or lowering said guiding means relative to said belt.

6. An image recorder capable of selectively recording an image on at least either of opposite sides of a paper sheet, comprising:

a rotatable photoconductive element;

optical writing means for writing a latent image on said photoconductive element in an inverted position or a non-inverted position;

developing means for developing said latent image to produce a primary toner image;

a belt facing said photoconductive element for causing a paper sheet to pass through between said belt and said photoconductive element;

intermediate image transferring means for transferring said primary toner image to said paper sheet or transferring said primary toner image to said belt as a secondary toner image;

secondary toner image transferring means located downstream of said intermediate image transferring means and comprising bias roller transferring means fixed in place for transferring said secondary toner image to said paper sheet;

fixing means comprising a pair of rollers for fixing by heat any of said toner images transferred to said paper sheet being driven out from said belt; and displacing means for displacing said belt into and out of contact with said bias roller transferring means.

7. An image recorder as claimed in claim 6, wherein said intermediate image transferring means transfers said primary toner image while said belt is out of contact with said bias roller transferring means, said secondary toner image transferring means transferring said secondary image while said belt is in contact with said bias roller transferring means.

8. An image recorder as claimed in claim 6, wherein said fixing means further comprises an upper guide and a lower guide for guiding said paper sheet to said rollers of said fixing means, said paper sheet driven out from said belt entering a space between said upper and lower guides in a particular direction which differs from the time when said belt is in contact with said bias roller transferring means to the time when said belt is out of contact with said bias roller transferring means.

9. An image recorder as claimed in claim 8, wherein said direction in which said paper sheet enters said space is, when said belt is in contact with said bias roller transferring means, a direction in which the leading edge of said paper sheet contacts said upper guide or, when said belt is out of contact with said bias roller transferring means, a direction in which the leading edge of said paper sheet contacts said lower guide.

10. An image recorder as claimed in claim 6, wherein the displacement of said belt relative to said bias roller transferring means occurs in response to the switchover of a record mode.

11. An image recorder as claimed in claim 6, wherein said bias roller transferring means and said rollers of said fixing means are spaced apart by a distance which is shorter than the length of a paper sheet of minimum size applicable to said image recorder.

* * * * *